US005388478A

United States Patent [19]

Castle

[11] Patent Number: 5,388,478

[45] Date of Patent: Feb. 14, 1995

[54] TORQUE WRENCH HAVING A RAPID TRAVERSE ADAPTER AND A METHOD FOR ITS USE

[75] Inventor: George L. Castle, Terryville, Conn.

[73] Assignee: Barnes Group, Inc., Bristol, Conn.

[21] Appl. No.: 940,552

[22] Filed: Sep. 4, 1992

[51] Int. Cl.[6] ..... B25B 13/46

[52] U.S. Cl. ..... 81/57.39; 81/58.1

[58] Field of Search ..... 81/57.39, 58.1, DIG. 11, 81/185, 437–439, 124.4, 180.1

[56] References Cited

U.S. PATENT DOCUMENTS

| | | | |
|---|---|---|---|
| 45,165 | 1/1814 | Warren . | |
| 773,462 | 10/1904 | Benton . | |
| 1,158,085 | 10/1915 | Tennyson . | |
| 1,305,249 | 6/1919 | Buck | 81/58.1 |
| 1,330,673 | 2/1920 | Anderson . | |
| 1,359,325 | 11/1920 | Butler | 81/58.1 |
| 1,787,087 | 12/1930 | Robertson . | |
| 1,970,179 | 8/1934 | Miller . | |
| 2,069,882 | 2/1937 | Hall . | |
| 2,299,956 | 10/1942 | Stever . | |
| 2,910,901 | 11/1959 | Ryd . | |
| 2,961,904 | 11/1960 | Sergan . | |
| 3,253,626 | 5/1966 | Stillwagon, Jr. et al. . | |
| 3,289,503 | 12/1966 | Klatt, Jr. . | |
| 3,575,069 | 4/1971 | White | 81/58.1 |
| 3,625,095 | 12/1971 | Barnett et al. . | |
| 3,686,983 | 8/1972 | Flagge . | |
| 3,752,202 | 8/1973 | Condon . | |
| 3,791,242 | 2/1974 | Bartusch | 81/57.39 X |
| 3,868,872 | 3/1975 | Wing . | |
| 4,054,067 | 10/1977 | Blank | 81/58.1 |
| 4,091,451 | 5/1978 | Weiner et al. . | |
| 4,137,800 | 2/1979 | Austin . | |
| 4,183,260 | 1/1980 | Wagner et al. | 81/57.39 X |
| 4,211,128 | 7/1980 | Plumer . | |
| 4,375,122 | 3/1983 | Sigmund . | |
| 4,407,175 | 10/1983 | Graham | 81/58.1 X |
| 4,409,865 | 10/1983 | Krautter et al. . | |
| 4,437,365 | 3/1984 | Yaari . | |
| 4,449,722 | 5/1984 | Knaggs . | |
| 4,506,567 | 3/1985 | Makhlouf . | |
| 4,706,527 | 11/1987 | Junkers . | |
| 4,744,271 | 5/1988 | Collins . | |
| 4,794,825 | 1/1989 | Schmoyer | 81/57.39 |
| 4,838,130 | 6/1989 | Snyder . | |
| 4,845,998 | 6/1989 | DeMartelaere et al. . | |
| 4,846,028 | 7/1989 | Junkers | 81/57.39 |
| 4,976,159 | 12/1990 | Snyder . | |
| 5,056,384 | 10/1991 | Sergan . | |
| 5,095,780 | 3/1992 | Beuke | 81/57.39 |
| 5,152,196 | 10/1992 | Garrett | 81/58.1 |

FOREIGN PATENT DOCUMENTS

| | | |
|---|---|---|
| 957918 | 11/1974 | Canada . |
| 0018115 | 10/1980 | European Pat. Off. . |
| 53219 | 5/1981 | European Pat. Off. . |
| 0133557 | 2/1985 | European Pat. Off. . |
| 2231949 | 2/1973 | Germany . |
| 2509361 | 9/1975 | Germany . |
| 3221658 | 12/1983 | Germany . |
| 3222156 | 12/1983 | Germany . |
| 349938 | 12/1960 | Switzerland . |
| 621883 | 7/1980 | U.S.S.R. . |
| WO90/01399 | 2/1990 | WIPO . |

*Primary Examiner*—D. S. Meislin

*Attorney, Agent, or Firm*—Pennie & Edmonds

[57] ABSTRACT

A torque wrench in which large torquing forces are applied to a workpiece by a ratchet and pawl mechanism allows the workpiece to be pretightened before final tightening by the wrench and includes an adapter assembly for transmitting torquing forces delivered independently of the pawl to the ratchet. The adapter assembly, which may be adapted for use with any ratcheting torque wrench, comprises an adapter member which is interlockingly received at one end within an axial opening of a ratchet gear and which includes at its other end a central aperture, a male extension, or a combination of the two for coupling to an external torque transmitting device such as an open ended wrench or an air powered wrench. Additional transition members are optionally provided to adapt the adapter member for use with commercially available torque transmitting devices. By allowing a threaded fastener or other workpiece to be pretightened, the cumbersome process of removing and reinstailing the torque wrench when untightened fasteners are encountered is avoided.

4 Claims, 2 Drawing Sheets

TORQUE WRENCH HAVING A RAPID TRAVERSE ADAPTER AND A METHOD FOR ITS USE

BACKGROUND OF THE INVENTION

This invention relates to a fastener driving tool, and in particular one comprising an adapter means for use in combination with a power torque wrench to rapidly rotate a socket member of the torque wrench prior to final torquing.

Various power torque wrenches are known in the art in which a ratchet mechanism rotates an output shaft and a socket coupled thereto about a central axis to loosen or tighten threaded fasteners. In some wrench designs, such as that described in U.S. Pat. No. 4,506,567 to Makhlouf, an internal gear and chain drive effects the rotation of the ratchet mechanism. In other designs, such as in those intended to deliver high torquing forces, the ratchet pawl is driven by a reciprocating fluid actuated piston, thereby converting linear force into angular force.

A variety of means have also been proposed for coupling the article engaging socket to the ratchet mechanism of a torque wrench. U.S. Pat. No. 4,838,130 to Snyder, for example, describes a power torque wrench which combines the features of a ratchet gear and article engaging socket in a single component. The '130 device utilizes an annular disc member having an interior opening corresponding to the size of the fastener to be turned and an outer peripheral edge having a plurality of flat surfaces. Each adjacent pair of flat surfaces forms a point with the direction of the points alternating between the interior and exterior of the disk member. A piston driven pawl engages against a flat section of the disk member to thereby rotate a threaded member retained within the interior opening. U.S. Pat. No. 2,961,904 to Sergan utilizes a central member also driven by hydraulic cylinders to rotate a threaded fastener or an auxiliary tool carrying an appropriately shaped fastener engaging element.

In U.S. Pat. No. 4,137,800 to Austin, it is proposed that a ratchet mechanism of a torque wrench include a tubular shaft provided with a splined outer peripheral surface portion to define a plurality of teeth which are engaged by a pawl for rotation. The interior surface of the shaft defines a plurality of longitudinally extending female splines. A single socket receiving adapter has a socket engaging extension on one end and splines on the opposite end which are dimensioned so as to be received within the female splines of the output shaft. The adaptor may be removed from one side of the shaft and replaced on the other side so that bolts may be loosened or tightened as desired. Other torque wrenches utilizing output shafts having female splines for receiving correspondingly splined socket adapters are described in U.S. Pat. Nos. 4,706,527 and 5,056,384.

Each of the torque wrenches discussed above are capable of applying relatively high torquing forces (at varying levels of precision). However, one drawback associated with such systems is that they are inefficient in applications where many turns of the threaded fasteners are necessary before any high tightening force is required. Specifically, the relatively short travel of the fluid actuated pistons limits rotation of the output shaft and socket attached thereto to relatively small increments. As a result, use of such prior art power torque wrenches to tighten fasteners from a loosened condition to a position for final torquing requires many actuations and can be very time consuming.

U.S. Pat. No. 4,137,800 attempts to avoid the failings of the other prior art devices by incorporating a provision enabling the user to detachably connect an extension handle whereby a torque output may be manually applied to the output shaft. A torque arm coupled to the output shaft is rotated by engagement with a reciprocating block connected to the piston. To pretighten a threaded fastener, the user of the '800 wrench inserts the extension handle into a cavity of the torque arm and rotates it manually, thereby overriding the hydraulic actuator section of the wrench.

While the patented wrench disclosed in the '800 patent is an improvement over previously available wrenches in that it expedites pretightening of threaded fasteners, its design is still not satisfactory for all situations. The manually operated handle can only be rotated approximately 180° at a time and does not allow for use with a power tool such as an air wrench. This device thus also requires the user to expend extra time and energy where many untightened fasteners are involved. The operating speed is a very important criteria in torque wrenches as described herein, especially if the wrench is to be successfully utilized in limited manpower situations.

SUMMARY OF THE INVENTION

Thus, it is an object of the present invention to provide an adapter for use in a power operated torque wrench to facilitate rapid pretightening of loose threaded fasteners prior to the application of high tightening forces by the torque wrench. Accordingly, a feature of the invention is the inclusion of an adaptor having provisions for coupling the ratcheted output shaft of a torque wrench to the output connector of auxiliary tools such as a hand held ratchet wrench or a high speed, compressed air-driven wrench. This feature permits initial tightening using auxiliary, power operated force transmitting means when high speed is required, but also allows manual pretightening via hand held ratchet wrenches and the like.

A further object of the invention is to provide a flexible adaptor assembly capable of use with output connectors of varying dimensions. A feature of this invention is therefore to provide means for interchangeably coupling the adaptor to differently dimensioned connectors of various force transmitting means.

In general, these and other objects are achieved by a torque wrench having a power actuated ratchet mechanism for tightening threaded fastener members and an adapter system for receiving and transmitting tightening forces from the ratchet mechanism to a socket which receives the fastener members. The adapter assembly is also constructed to receive and transmit tightening forces delivered independently of the ratchet mechanism.

The adapter assembly includes a first member which has a first end portion defining a central aperture for receiving the independently delivered tightening force and having a peripheral surface for driven engagement with the ratcheting mechanism. The first member further includes a second end portion for engagement with a socket positioned over a fastener to be tightened. The peripheral surface of the first member is adapted to engage a complementary surface of the ratcheting mechanism and to receive tightening forces transmitted thereby. Preferably, the peripheral surface of the first member defines at least one longitudinal projection extending therealong, such as a spline, and a surface of the ratchet is correspondingly recessed to receive any such projections.

The central aperture of the first member has a polygonal cross section for receiving the output extension member of an auxiliary force transmitting means such as a hand held ratchet or high speed air wrench. The central aperture preferably has a square cross section configured to match the output extensions of commercially available ratchet devices. In a preferred embodiment of the first member, opposite interior faces of the aperture are ½" apart.

So that independently developed tightening forces may be delivered to the first member using an output extension smaller than the central aperture, the adapter means further comprises a second member which serves as a transition between the auxiliary force transmitting means and the first member. The second member comprises at one end a projection dimensioned and arranged for retention in the central aperture of the first member and defines at its other end a central aperture dimensioned to receive an output extension member of the auxiliary force transmitting means.

The central aperture of the second member has a polygonal cross section which is smaller than the cross section of the central aperture of the first member but which is also configured to match the output extensions of commercially available ratchet devices.

In order to deliver independently developed tightening forces to the first member using an output extension smaller than the central apertures of both the first and second members, the adapter means further comprises a third member which serves as a transition between the auxiliary force transmitting means and the second member. The third member comprises at one end a projection dimensioned and arranged for retention in the central aperture of the second member and defines at its other end a central aperture having a polygonal cross section which is smaller than the cross section of the apertures of the first and second members but is also dimensioned to receive an output extension member of the auxiliary force transmitting means.

DETAILED DESCRIPTION OF THE PREFERRED EMBODIMENT

Figure 1:
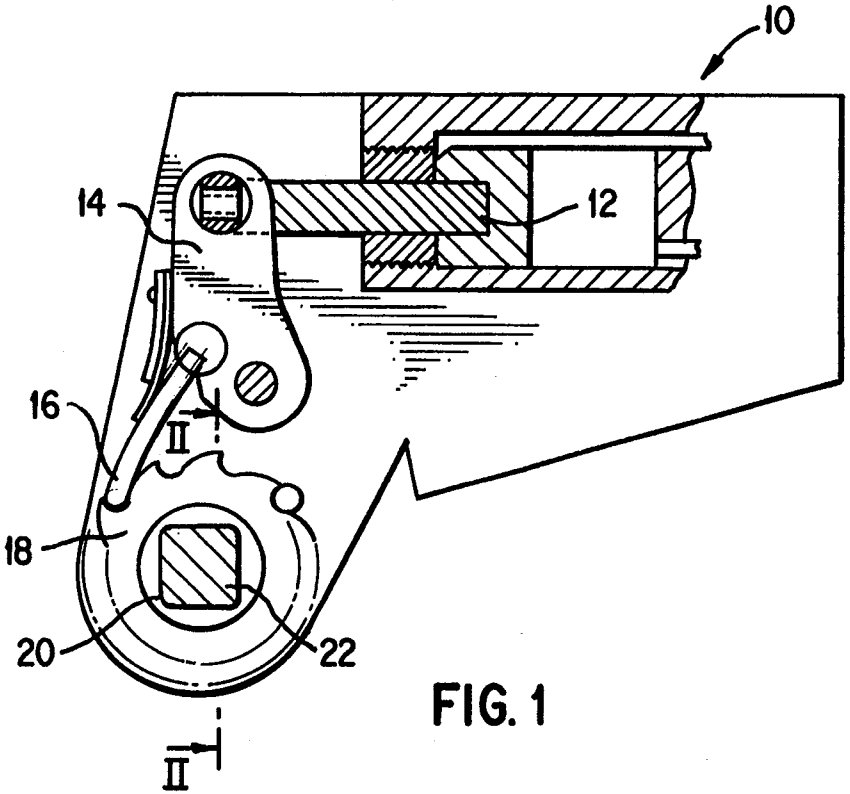
FIG. 1 is a cross sectional view from the top of a torque wrench ratchet drive mechanism, into which an adapter constructed in accordance with an embodiment of the present invention is positioned.

FIG. 1 illustrates an adapter in accordance with the present invention positioned within a ratchet driven torque wrench 10. In FIG. 1, a single actuating cylinder is shown. Multiple cylinders or other actuating means may be used with the present invention. Generally, it should be readily appreciated by those of ordinary skill in the art that the adapter of the present invention may be utilized in any torque wrench design utilizing a ratcheted output shaft. By output shaft it is generally meant the member which transmits torque to the article being torqued; this member may be, for example, cylindrical or solid with sockets.

The torque wrench 10 includes a hydraulic actuator 12 and operates in a well known manner to pivot linkage 14 and pawl 16 coupled thereto. Pawl 16, in turn, engages ratchet gear 18 and turns it incrementally in a conventional manner. Ratchet gear 18 is provided with an upwardly extending cylindrical shaft portion 24 (FIG. 2), having a circular cross section and a smooth exterior surface 23 for rotatable support within fixed sleeve bearing 26. Ratchet gear 18 and shaft portion 24 together define an internal driving member which transmits torque to the article being torqued. Shaft portion 24 preferably defines an axial opening into which an adapter as described below is positioned.

Figure 2:
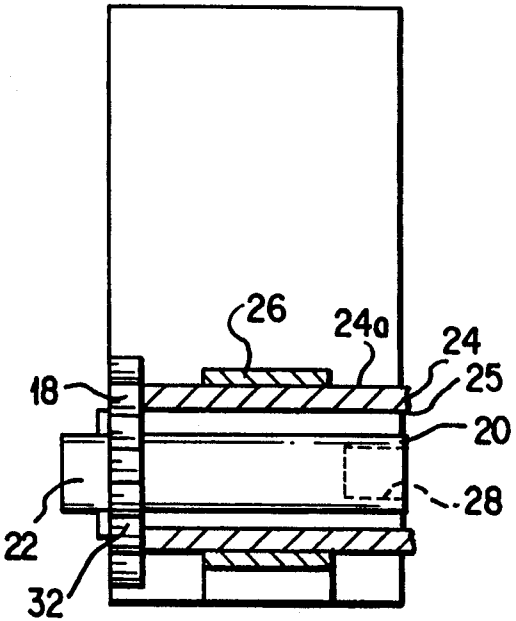
FIG. 2 is a partial cross sectional view taken along line II—II of FIG. 1 showing the internal arrangement of one embodiment of the adapter within a drive mechanism.

In one embodiment of the invention, illustrated in FIGS. 1 and 2, adapter 20 is positioned concentrically within the ratchet gear so as to be turned with the internal drive member due to action of actuator 12 and pawl 16. In order to transmit torque from wrench 10 to the article, a first end of adapter 20 is equipped with engaging extension 22. Extension 22 projects beyond the surface of ratchet gear 18.

Although a solid extension having a square cross section is illustrated, it is contemplated that any shape and configuration may be used, depending upon the application. For example, extension 22 may be machined to have an inner aperture having a cross section configured to mate with the surface of the fastener or workpiece to be engaged. Alternatively, the extension may have a hexagonal cross section, such as that employed by allen wrenches. Preferably, however, extension 22 conforms to the shape and dimensions associated with commercially available sockets, including ¼", ½", ¾", 1", ½", etc.

To provide faster rotation of the ratchet than is possible by repeated operations of the ratchet mechanism with hydraulic actuator 12, the second end of adapter 20 defines a central aperture 28 which is dimensioned to receive the output of a commercially available, auxiliary torque transmitting means (not shown), such as an air powered wrench, manual ratchet wrench, or the like. Preferably, aperture 28 has a square cross section and is dimensioned to accommodate standard sized extensions such as those indicated in connection with the preferred dimensions of extension 22. As an alternative to providing a central aperture on the second end of adapter 20, it is also contemplated that a suitably dimensioned male extension might be used. Thus, a correspondingly dimensioned, commercially available socket such as that normally used with a conventional air wrench could be placed over the male extension so as to transmit torque to the fastener retained by the socket or like means coupled to extension 22. In yet another alternative, the second end of the adapter may be advantageously equipped with a male extension having a central aperture so that the adapter is able to receive and transmit torquing forces from any of the auxiliary force transmitting means discussed above.

Figure 3:
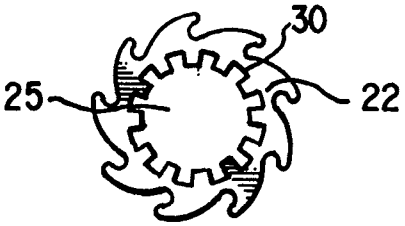
FIG. 3 is a cross sectional view showing an arrangement of complementary female splines in a ratchet shaft for receiving an adapter constructed in accordance with one embodiment of the present invention.

As best shown in FIG. 3, in order to facilitate the transmission of rotary power from ratchet gear 18 to adapter 20, the central opening 25 of shaft portion 24 is preferably provided with a plurality of longitudinal female splines 30 on its interior surface for interlocking engagement with corresponding male splines 32 on the surface of adapter 20. Although longitudinal splines are preferred, it is also within the scope of the present invention to utilize different types of projections or fastening devices to accomplish the desired force transmitting relationship between ratchet gear 18 and adapter 20. For example, the interior of ratchet gear 18 may be provided with one or more circumferentially spaced projections and the adapter may be provided with corresponding grooves to receive the projections in interlocking relation. If desired, ratchet gear 18 and adapter 20 may even be formed as an integral assembly such that no interlocking is required and the entire ratchet gear and adapter remains in the wrench until an extension having different dimensions is required.

Figure 4:
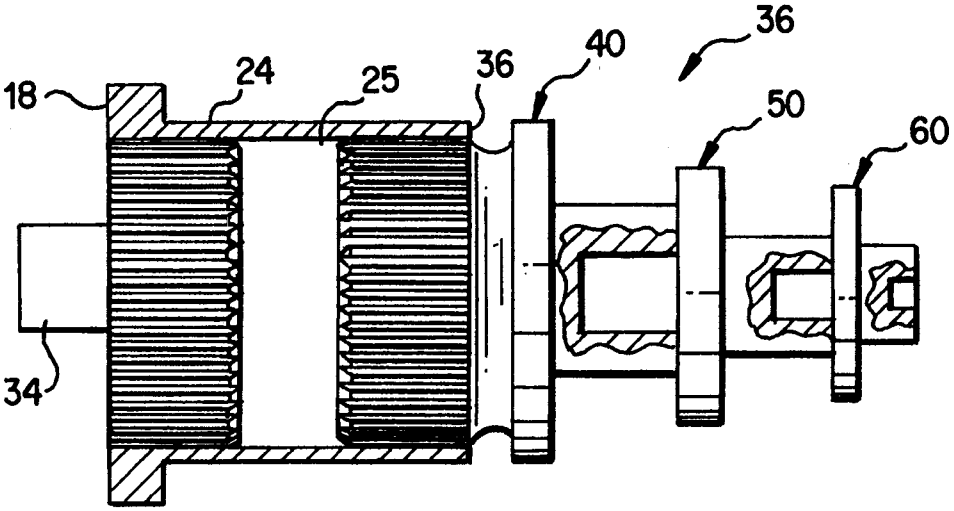
FIG. 4 is a partially broken away cross sectional view representing another embodiment of an adapter assembly constructed in accordance with the present invention.

Referring now to FIG. 4, a further preferred embodiment of an adapter assembly in accordance with the present invention will be described. For delivering the torque of ratchet gear 18 to a workpiece engaging socket, a splined socket adapter 34 is positioned within one end of complementarily splined opening 25. To deliver the torque of an auxiliary power or manual tool to ratchet gear 18, a rapid traverse adapter assembly 36 comprising one or more interlocking members 40, 50, and 60 is provided.

Figure 5:
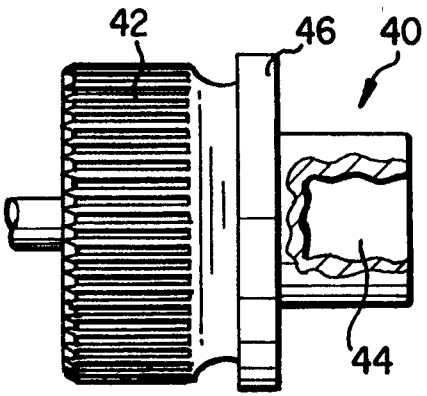
FIG. 5 is a side view of a first member of the adapter assembly in accordance with the embodiment of FIG. 4.

As best shown in FIG. 5, first adapter member 40 preferably comprises a first end having a splined exterior 42 configured for interlocking relation within the complementarily splined interior surface of central cavity 25. A second end of member 40 defines an extension receiving aperture 44. The shape and dimensions of aperture 44 are selected in accordance with the same considerations discussed in connection with adapter 20, supra. When properly positioned within opening 25, the bottom surface of abutting lip portion 46 seats on the annular surface 36 (shown in FIG. 4) of shaft portion 34, thereby retaining member 40 in proper relation.

Figure 6:
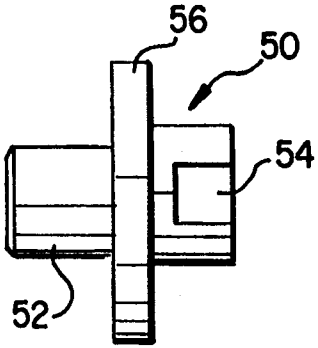
FIG. 6 is a side view of a second member of the adapter assembly in accordance with the embodiment of FIG. 4.

As best shown in FIG. 6, second adapter member 50 includes an engaging extension 52 at one end and a receiving aperture 54 at the opposite end. The purpose of second member 50 is to accommodate an output extension of an auxiliary force delivery means which is too small or large to fit snugly into aperture 44 of the first member. To this end, engaging extension 52 is dimensioned and shaped so as to be snugly received within aperture 44. In the particular embodiment of FIGS. 4–7, aperture 54 is dimensioned to receive a smaller extension member than is capable of fitting snugly into aperture 54. As discussed in connection with adapter 20, above, the aperture may be centrally provided within a hexagonal or alternatively shaped male extension in order to accommodate engagement by conventional sockets as well. A peripheral lip portion 56 is provided to maintain second member 50 in seated relation with first member 40.

Figure 7:
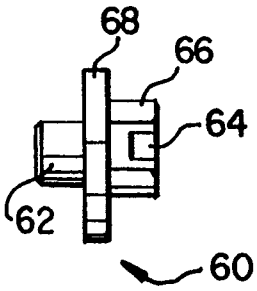
FIG. 7 is a side view of a third member of the adapter assembly in accordance with the embodiment of FIG. 4.

Referring now to FIG. 7, third adapter member 60 is most clearly shown. The purpose of third member 60 is to accommodate an output extension which is too small to fit snugly into apertures 44 or 54. For this purpose, one end of member 60 includes engaging extension 62 which is dimensioned and shaped so as to be snugly received within aperture 54. At the other end of member 60, aperture 64 is preferably provided within a hexagonal male extension 66 in order to accommodate engagement by conventional sockets as well as output extensions. When third member 60 is positioned so that extension 62 is fully received within aperture 54, peripheral lip portion 68 seats on the top surface of second member 50.

The invention has been described above by reference to a "generic" ratcheting torque wrench. The adapter according to the present invention is particularly well suited for use in high power wrenches employing central rotating ratchet mechanisms, such as disclosed in applicant's U.S. patent application Ser. No. 5,203,239 which is incorporated in its entirety herein by reference thereto.

The method of using the adapter or adapter assembly according to the invention with a wrench may thus be summarized as follows:

1. Install the proper socket engaging adapter within the splined ratchet gear 18 and attach an article engaging socket thereto. Also install the wrench on a torque reaction member if required and secure the wrench against reaction forces.
2. Choose a rapid traverse adapter having an appropriately sized aperture and/or male extension and install the same within the splined ratchet gear so that the aperture/extension is facing upwardly. (Steps 1 and 2 are performed together if adapter 20 is used instead of adapter assembly 36).
3. Rapidly turn the rapid traverse adapter by engaging a male extension with an open end or socket wrench or by inserting an extension member of a hand held ratchet wrench or power driver and turning the same, until the article is tightened to a pretorque as desired.
4. Actuate the ratchet pawl by energizing the actuating means of the wrench until the desired final torque is reached.

As will be apparent to those of ordinary skill in the art, various modifications and adaptations of the structure above described will become readily apparent without departure from the spirit and scope of the invention, the scope of which is defined in the appended claims.

What is claimed is:

1. A torquing kit for rapidly applying pretorque with a fluid power driven wrench having a central, torque transmitting ratchet with an internally splined opening extending through the wrench, said kit comprising:

a first adapter member having first and second ends wherein the first end has an externally splined peripheral surface configured to mate with the internally splined ratchet of the wrench and wherein the second end defines a projection for engaging a socket tool;

a second adapter member having first and second ends wherein the first end has an externally splined peripheral surface configured to mate with the internally splined ratchet of the wrench opposite said first adapter member, and wherein the second end defines a recess of non-circular cross section; and a third adapter member having first and second ends wherein the first end defines a projection with a non-circular cross section configured and dimensioned to be received in the recess of the second adapter member for transmission of torque thereto and wherein the second end defines a recess having a non-circular cross section smaller than the second adapter member recess such that said recesses may be alternately engaged by different sized torquing tools for transferring torque to the first adapter member through said ratchet.

2. The kit according to claim 1, wherein said second and third adapter members are configured and dimensioned to be engaged alternately with manual turning means and high speed automated turning means.

3. The kit according to claim 1, wherein the first ends of said second and third adapter members include a projection having a polygonal cross section.

4. The kit according to claim 1, wherein the second ends of said second and third adapter members include a recess having a polygonal cross section and said recess is configured and dimensioned to receive an auxiliary force transmitting member.

* * * * *